US007984725B1

(12) United States Patent
Johnson et al.

(10) Patent No.: US 7,984,725 B1
(45) **Date of Patent: *Jul. 26, 2011**

(54) COLLAPSIBLE BLIND

(75) Inventors: Brooks Johnson, Monticello, MN (US); Keith Beam, Elk River, MN (US)

(73) Assignee: Primos, Inc., Flora, MS (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/774,596

(22) Filed: May 5, 2010

Related U.S. Application Data

(63) Continuation of application No. 12/345,548, filed on Dec. 29, 2008, now Pat. No. 7,717,124, which is a continuation of application No. 11/024,143, filed on Dec. 24, 2004, now Pat. No. 7,475,699.

(51) Int. Cl.
*E04H 15/54* (2006.01)
*E04H 15/58* (2006.01)
*E04H 15/64* (2006.01)

(52) U.S. Cl. ..... 135/115; 135/117; 135/119; 135/901

(58) Field of Classification Search ..... 135/115, 135/117, 119, 901; 160/130, 180, 349.2
See application file for complete search history.

(56) References Cited

U.S. PATENT DOCUMENTS

| | | | | |
|---|---|---|---|---|
| 574,091 | A * | 12/1896 | Irvine, Jr. | 135/96 |
| 851,141 | A | 4/1907 | Stempel | |
| 1,079,757 | A | 11/1913 | Gould | |
| 1,376,218 | A | 4/1921 | Morant | |
| 1,854,671 | A * | 4/1932 | Roberts | 24/537 |
| 2,803,298 | A | 8/1957 | Schlesinger | |
| 3,255,809 | A | 6/1966 | Kawcynski | |
| 4,437,505 | A | 3/1984 | Rodgers | |
| 4,473,087 | A | 9/1984 | Cavender | |
| 5,010,909 | A | 4/1991 | Cleveland | |
| 5,193,602 | A | 3/1993 | Morales | |
| 5,762,085 | A | 6/1998 | Punch | |
| 5,765,584 | A | 6/1998 | Heisler et al. | |
| 6,021,794 | A | 2/2000 | Guerra | |
| 6,499,497 | B1 | 12/2002 | Swetish et al. | |
| 6,892,744 | B2 | 5/2005 | Feldspausch et al. | |
| 7,475,699 | B2 | 1/2009 | Johnson et al. | |
| 2002/0069904 | A1 | 6/2002 | Robinson | |
| 2003/0116287 | A1 | 6/2003 | Titus et al. | |
| 2005/0199356 | A1 | 9/2005 | Nien et al. | |

* cited by examiner

*Primary Examiner* — David Dunn
*Assistant Examiner* — Tania Abraham
(74) *Attorney, Agent, or Firm* — Holland & Hart

(57) ABSTRACT

A portable and collapsible blind including a flexible cover mounted on a support structure having a plurality of side walls and a top; wherein at least one side wall includes first and second opposite edges, and the opposite edges cooperatively defining a window; an elongated member extending across the opposite edges; and a selective fastener joined to one edge and adjustably joined to the strap, the fastener selectively being fixedly joinable to the elongated member.

16 Claims, 4 Drawing Sheets

COLLAPSIBLE BLIND

RELATED APPLICATIONS

This is a continuation of U.S. patent application Ser. No. 12/345,548, filed 29 Dec. 2008, now pending, which is a continuation of U.S. patent application Ser. No. 11/024,143 filed 24 Dec. 2004, now U.S. Pat. No. 7,475,699, the disclosures of which are incorporated, in their entireties, by this reference.

FIELD OF THE INVENTION

This invention relates to portable and collapsible shelters for the use by sportsmen and more particularly relates to portable and collapsible blinds for use by hunters and photographers.

BACKGROUND OF THE INVENTION

Hunters, photographers, bird watchers, etc. often desire or have a need to remain hidden from view of wildlife they are observing or pursuing. Although permanent blinds or shelters have been used for this purpose, the lack of adjustability of the structures is a significant disadvantage.

The blinds are often placed on rough terrain. The manufacturer does not know whether the occupant will be looking up a hill or down in a valley from inside the blind. The manufacturer does not know the height of the occupant's chair or if they are even using one. Moreover, the blind may be placed on ground so rough that the blind rests at an angle. All these factors impact the proper location of the window(s). That is, the location of the occupant's eyes inside the blind and the area to be observed outside the blind need to be in a direct line passing through the window.

In the past, windows have been made large, which has an additional drawback. Game can generally see in the window that the occupant looks out. For the occupant to be truly hidden, the window gap needs to be able to remain small, while in position for observation.

Game typically moves on game trails. The game tends to follow a known path and crosses expected locations. Not all of these locations are ideal for shooting either a camera or a weapon. The hunter may not need or want windows in locations from which the game is unreachable. In some locations, the game may come from any direction and other times not. However, present blinds lack the ability to laterally enlarge or shrink the window such that it can circumscribe the blind or only provide one small peak hole.

An example of the shortcomings in the prior art can be found in U.S. Pat. No. 4,819,680, which describes a ground tent having four sides and a top, with a plurality of poles having a spring-biased foot subassembly supporting a fabric cover. Such a structure is not practical for use as a blind and it is time-consuming to set up when needed. This tent does not have a variable slot for observation of game through which the hunter may extend a rifle and shoot the game.

U.S. Pat. No. 3,105,505 describes a portable and collapsible tent having four walls, a floor and a dome ceiling. This structure is not suitable for use as a blind. This tent does not have a variable slot for observation of game through which the hunter may extend a rifle and shoot the game.

U.S. Pat. Nos. 4,026,312 and 3,941,140 describes a foldable free-standing tent having end walls, a floor and side walls which slope upwardly to a peak. This structure is cumbersome to set up and is not suitable as a blind. This tent does not have a variable slot for observation of game through which the hunter may extend a rifle and shoot the game.

U.S. Pat. No. 3,625,235 describes a portable shelter which is sphere-shaped and requires several supporting poles or rods. It is cumbersome to set up and take down and would not be suitable for use as a blind in the field. This portable shelter does not have a variable slot for observation of game through which the hunter may extend a rifle and shoot the game.

U.S. Pat. No. 3,968,809 describes a van tent, i.e., a tent-like extension for attachment to the rear of a van. This structure is useful as a shelter for workmen who require easy access to their van for tools and materials and who do not desire to go out into the elements while working. This structure is not at all suitable as a temporary blind in the field because it requires a van to support it. This tent does not have a variable slot for observation of game through which the hunter may extend a rifle and shoot the game.

U.S. Pat. No. 5,628,338 describes a portable blind including an integral fabric forming four walls and top in what is typically referred as a pop-up construction. This blind has four resilient and flexible legs. The blind has at least one window including a flap movable between an open and a closed position. The blind also has a door that may be moved between an open and a closed position. This blind does not have a variable slot for observation of game through which the hunter may extend a rifle and shoot the game.

There has not heretofore been provided a light-weight, portable, easily collapsible blind or shelter having the combined features of the present invention. What is needed is a portable blind designed for easy set-up with variable windows that may be adjusted to the desired height at the bottom edge and desired height at the upper edge, thus allowing the window itself to be vertically moved to a preferred location with adjustability of the size of the window gap. Desirably, the window should be adapted to circumscribe the blind and be openable in any select portions thereof, while allowing other portions to remain closed.

SUMMARY OF THE PRESENT INVENTION

The present invention is a portable and collapsible blind. A flexible cover may be mounted on a support structure. The cover may have at least one side wall, e.g., perhaps conical, and a top with at least a portion of at least one side wall including first and second opposite edges. The opposite edges desirably cooperatively define a window. An elongated member, perhaps a strap or frame portion, extends across the opposite edges and a selective fastener joins to one edge and adjustably joins to the elongated member. The fastener selectively being fixedly joinable to the elongated member.

Advantageously, the present invention allows the window to be opened in a parallel or a skewed manner.

Also advantageously, the present invention allows the opening to be moved up or down the wall.

As yet another advantage, the present invention allows the window to bend around corners and curves.

As an even further advantage, the window of the present invention can be opened a user determined amount, in a user determined location, and in a user determined configuration.

These and other advantages will become clear from reading the below description with reference to the appended drawings.

DETAILED DESCRIPTION OF THE INVENTION

Figure 1:
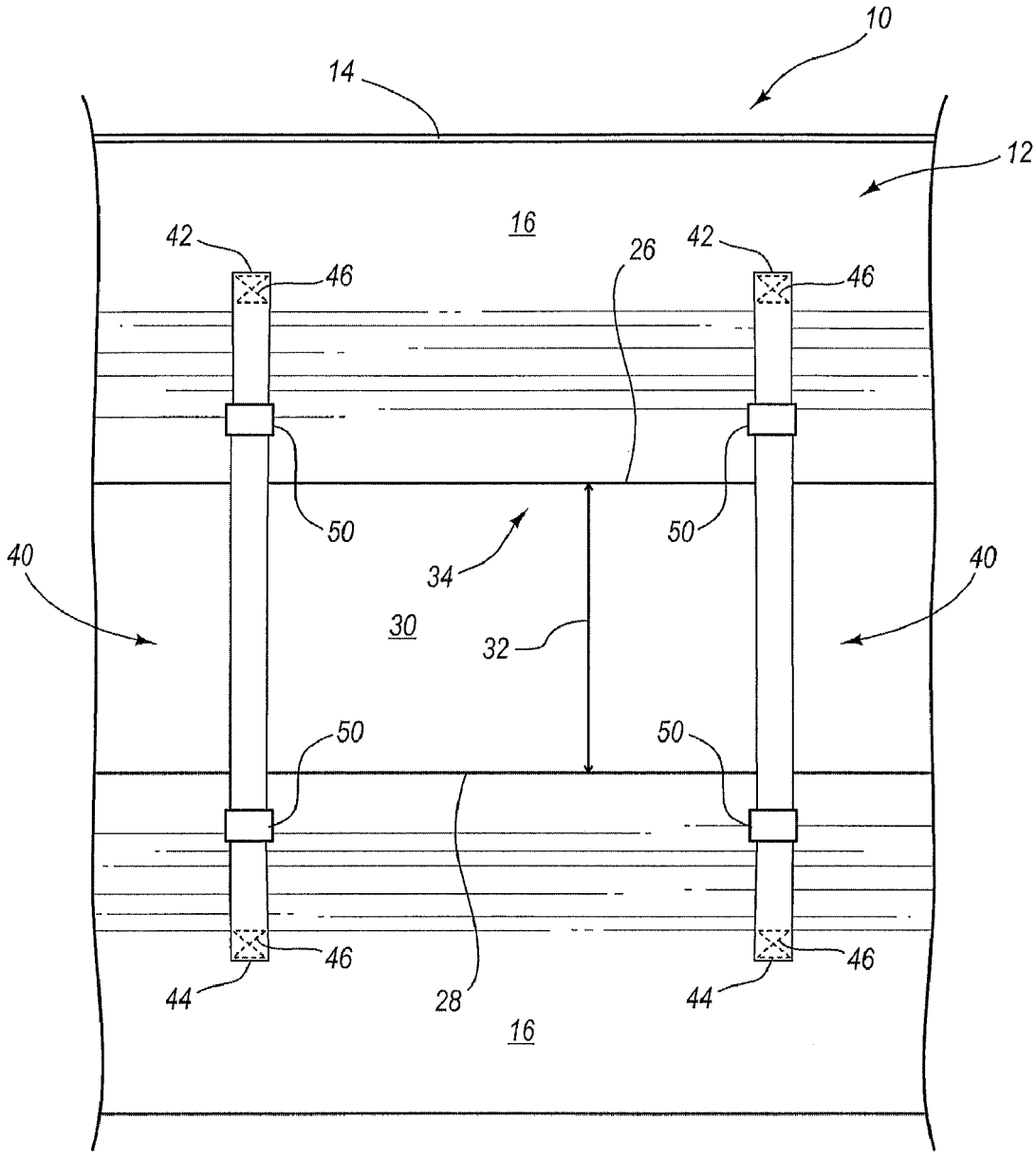
FIG. 1 is an interior view of the side wall showing the straps and fasteners disposed across the opposing edges together with the structure supporting the cover.
Figure 2:
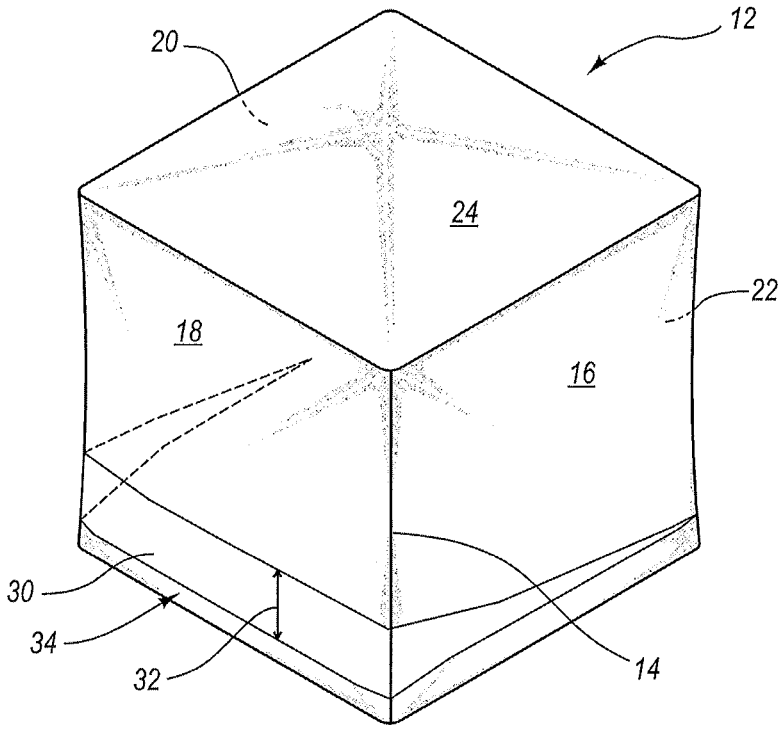
FIG. 2 is a perspective view showing the front and side of the blind with the window positioned low and partially shown in phantom.
Figure 3:
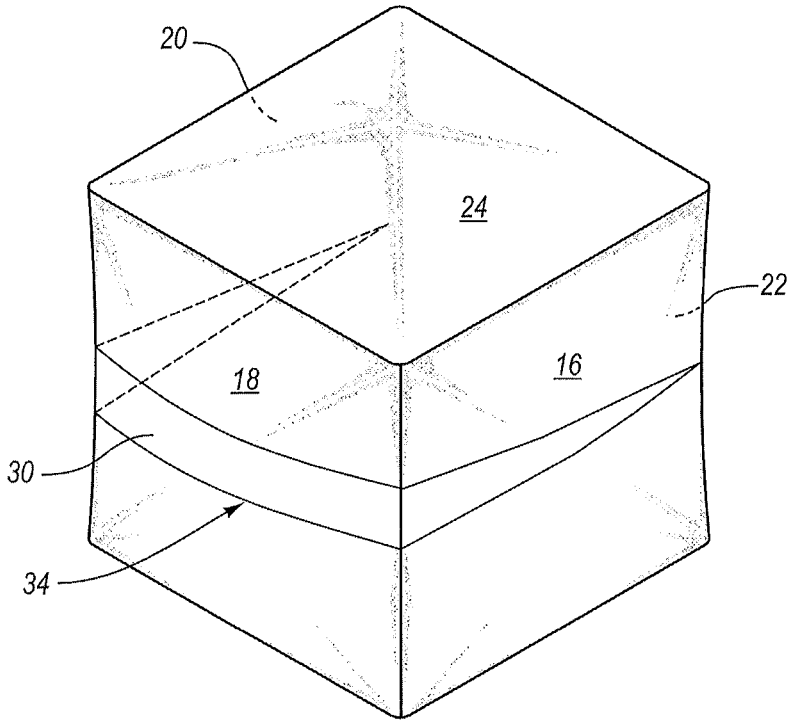
FIG. 3 is a perspective view showing the front and side of the blind with the window at medium height and partially shown in phantom.
Figure 4:
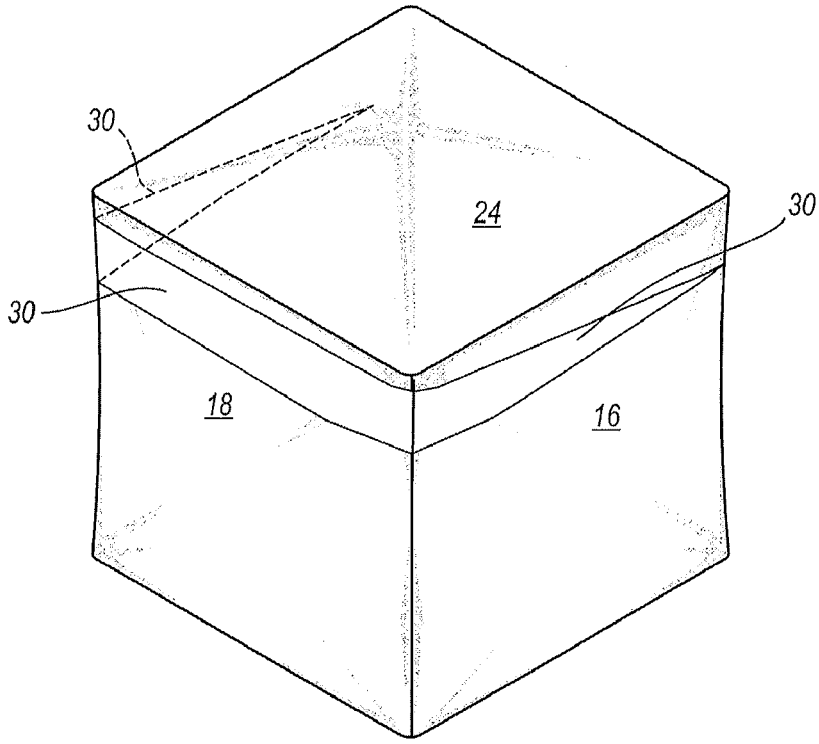
FIG. 4 is a perspective view showing the front and side of the blind with the window positioned at an elevated height and partially shown in phantom.
Figure 5:
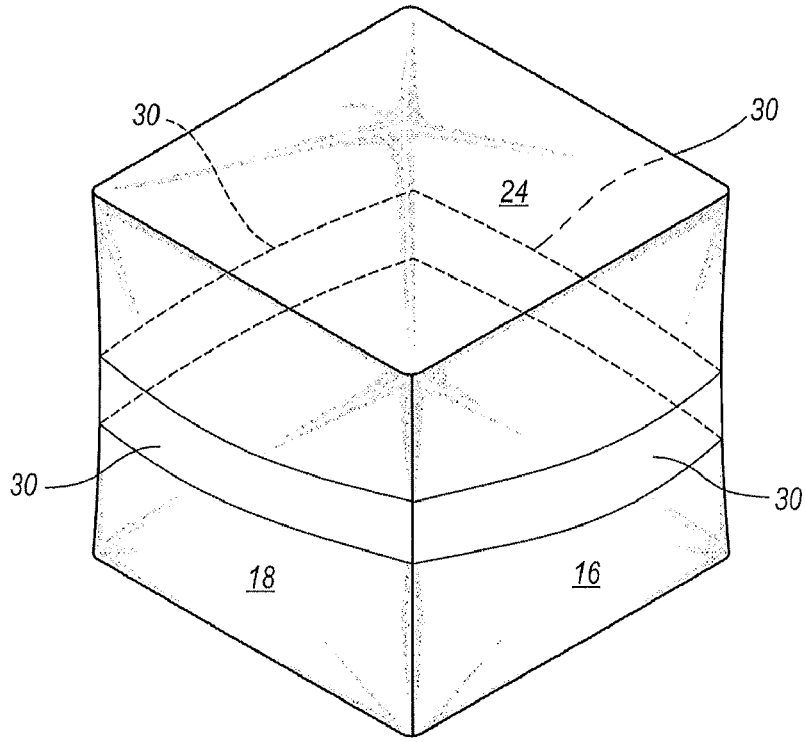
FIG. 5 is a perspective view showing the front and side of the blind with the window with parallel edges and partially shown in phantom.

The present portable and collapsible blind 10 may include a cover 12, at least one elongated member 40, and a fastener 50. The components through interconnections hereinafter described, provides a window that may extend around the blind 10 and is adjustable in a variety of unique manners. Each component will be discussed in serial fashion.

The flexible cover 12, which may be made of flexible materials, can be mounted on a support structure 14. The cover 12 may have at least one side wall 16, 18, 20, and 22 together with a top 24. A single side wall configuration can be used if desired, perhaps in a cylinder shape, which while commonly viewed as one side wall is technically an infinite number of side walls, or as a single flat surface wall. At least one side wall 16, 18, 20 and/or 22 may include a top edge 26 and a bottom edge 28, with the top and bottom edges 26, 28 cooperatively defining a window 30. The top edge 26 and bottom edge 28 are terms used relative to the window 30 and not the side walls 16, 18, 20, 22. Side walls 16, 18, 20, 22 may cooperatively provide the top edge 26 and 28 such that the window extends across a plurality of the sides.

At least one, but preferably a plurality of elongated members 40, which may be straps, poles, cords, or other similarly functional structures, extend across/adjacent the top and bottom edges 26, 28. The elongated members 40 may be vertical, perpendicular to the edges 26, 28 or in any other functional orientation. The elongated members 40 at each end 42, 44 may be secured a distance above the top edge 26 and below the bottom edge 28 of the side walls. The portion of the side walls 16, 18, 20 and 22 that is between the ends 42, 44 desirably has a surplus of fabric such that the bottom edge 28 may be lifted well beyond the point at which the top edge 26 may reach down. The overlap may appear to be structured as one or more flaps if the window is such that it cannot circumscribe the blind 10. The elongated member 40 is desirably positioned to be taut and is fastened at fastening point 46 perhaps with stitching to the side walls.

Figure 6:
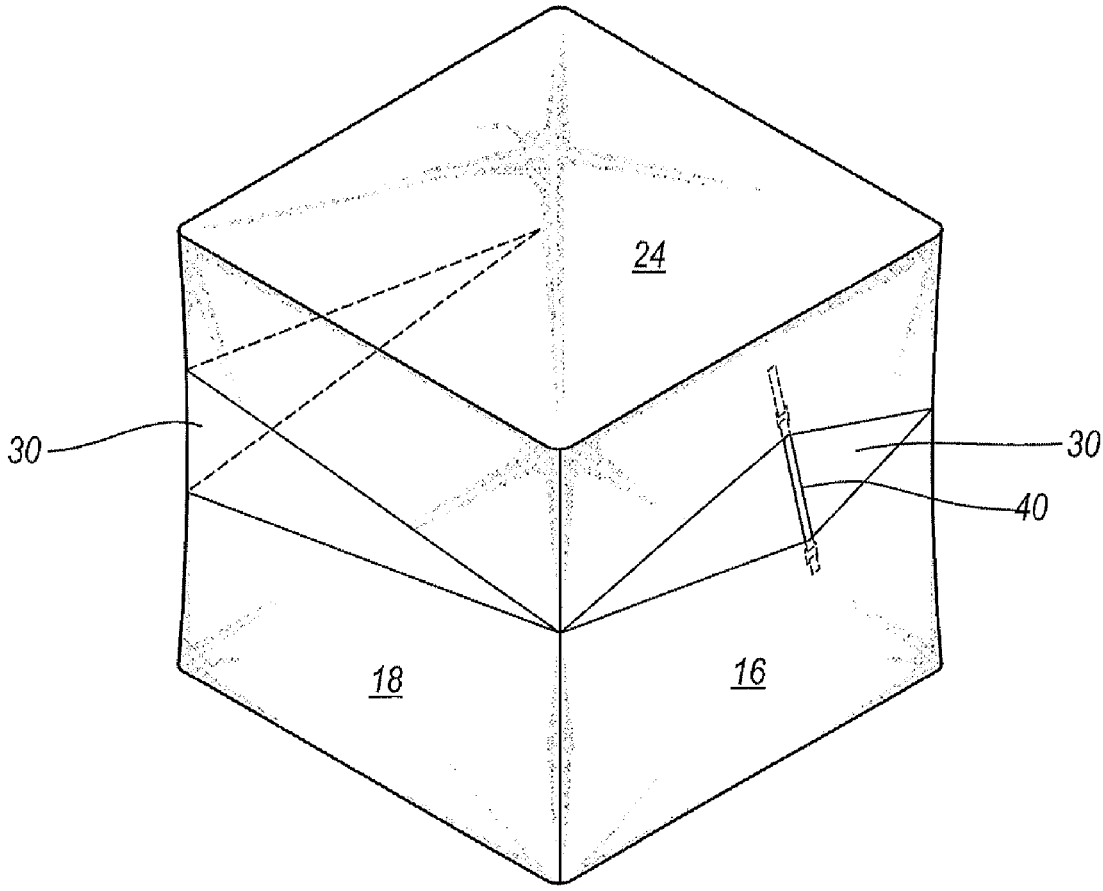
FIG. 6 is a perspective view showing the front and side of the blind with the window positioned with skewed edges and partially shown in phantom.

One may determine the height of the bottom edge 28 of the window 30 or the top edge 26 of the window 30 as shown in FIGS. 2-5. The gap 32 of the window 30 may then be determined via adjustment of the opposing edge 26 or 28. Multiple elongated members 40 allow the user to adjust the window position 34 and gap 32 at varying points along the length of the window 30, creating either a parallel, skewed or irregular relationship between the top and bottom edges 26, 28 of the window 30 as shown in FIG. 6.

A plurality of selective fasteners 50 can be independently and fixedly joined to the top and bottom edges 26, 28 of the window 30. Such fasteners 50 may join to the enlongated members 40, allowing the fastener 50 to selectively secure the top or bottom edges 26, 28 at the desired location relative to the elongated member 40. The preferred fastener is a clip 52 that permanently or fixedly secures to the top or bottom edge 26, 28 and slidably engages the elongated member 40 such that it may selectively lock to the elongated member 40 at any desired point. Other fasteners such as ties, hook and loop fabric, snaps, buttons or other suitably arranged fasteners are equivalents. The clips 52 allow independent adjustment of one of the edges 26, 28 at a point along the length thereof and securement of that edge at a fixed location relative to the blind 10 at that point.

The blind 10 has been described with the window 30 oriented a preferred direction, e.g., horizontally. One skilled n the art will realize that orienting the top and bottom edges 26, 28 such that they are side edge or angled edges with a corresponding movement of the elongated members 40 allow one to orient the window in any desired direction.

In operation, the user constructs the blind 10. The fasteners 50 secured to the bottom edge 28 are fastened to the elongated member 40 at a level where the user would prefer the bottom edge of the window 30. The user then secures the fasteners 50 joined to the upper edge 26 at a point along the elongated member 40 where the user would prefer to have the top edge of the window 30. The window 30 may be lowered via lowering the lower edge 28 and the window may be raised via raising the upper edge 26. In either case the opposing edge 26 or 28 may be used a corresponding amount to maintain size of the gap 32. Since each fastener 50 can be moved independently, the user can determine whether the edges 26, 28 are parallel, skewed or other arrangement.

Although the present invention has been described with reference to preferred embodiments, workers skilled in the art will recognize changes may be made in form and detail without departing from the spirit and scope of the invention.

What is claimed:

1. A blind, comprising:

a flexible cover mounted to a support structure having at least one side wall, a portion of the at least one side wall including top and bottom edges that define a window;

at least one elongated member permanently attached to the at least one side wall at a first point above the top edge and at a second point below the bottom edge, and adjustably attached to the at least one side wall at a third point between the first point and the top edge and at a fourth point between the second point and the bottom edge;

wherein adjusting the third and forth points relative to the at least one elongated member adjusts a vertical position of the top and bottom edges, respectively.

2. The blind of claim 1, wherein the third and fourth points are provided by a fastener that is mounted to the flexible cover and adjustably connected to the at least one elongated member.

3. The blind of claim 1, wherein the at least one elongated member comprises a plurality of elongated members mounted to the flexible cover at spaced apart locations around a periphery of the blind.

4. The blind of claim 1, wherein the window extends continuously around a periphery of the blind.

5. The blind of claim 1, wherein a first portion of the flexible cover extends between the third point and the top edge, and a second portion of the flexible cover extends between the fourth point and the bottom edge.

6. A blind, comprising:

a flexible cover mounted to a support structure having at least one side wall, a portion of the at least one side wall including top and bottom edges that define a window; and a window adjustment system that includes at least one elongated member attached to the at least one side wall at two vertically spaced apart points above the top edge and at least two vertically spaced apart points below the bottom edge, the window adjustment system being operable to independently adjust a vertical position of the top and bottom edges to vary a size and orientation of the window.

7. The blind of claim 6, wherein the window adjustment system is operable to selectively adjust the top and bottom edges between parallel and skewed orientations relative to each other.

8. The blind of claim 6, wherein at least one of the points of attachments of the at least one elongated member to the at least one side wall above the top edge is adjustable relative to the at least one elongated member, and one of the points of attachments of the at least one elongated member to the at least one side wall below the bottom edge is adjustable relative to the at least one elongated member.

9. A blind, comprising:

a flexible cover mounted on a support structure, the flexible cover defining a roof and a side wall, a continuous peripheral portion of the flexible cover extending around a periphery of the blind, the side wall including a top edge and a bottom edge that define a window that extends continuously around the blind;

wherein at least one of the top edge and the bottom edge are adjustable in height to alter at least one of a size, shape and orientation of the window relative to the support structure;

wherein the top edge and bottom edge are adjustable in height to overlap each other.

10. The blind of claim 9, wherein the top and bottom edges are independently adjustable in height.

11. The blind of claim 9, further comprising a plurality of elongated members extending across the window and being connected to the side wall at multiple locations above the top edge and multiple locations below the bottom edge.

12. A blind, comprising:

at least one side wall;

a window defined in the at least one side wall by a top edge and an opposing bottom edge;

wherein the at least one side wall includes surplus material above the window and surplus material below the window, the surplus material both above the window and below the window being manipulable to adjust vertically the position of the window.

13. The blind of claim 12, further comprising a plurality of elongated members extending across the window and being connected to the side wall at multiple locations above the top edge and multiple locations below the bottom edge, wherein at least some of the surplus material is provided between the locations where the elongated members are connected to the side wall above the top edge, and at least some of the surplus material is provided between the locations where the elongated members are connected to the side wall below the bottom edge.

14. A blind, comprising:

a flexible cover mounted on a support structure, the flexible cover defining a side wall that extends around a periphery of the blind, the side wall including a top edge and a bottom edge that define a window that extends continuously around the blind;

wherein at least one of the top edge and the bottom edge are adjustable in height to alter at least one of a size, shape and orientation of the window relative to the support structure;

wherein the top edge and bottom edge are adjustable in height to overlap each other.

15. The blind of claim 14, wherein the top and bottom edges are independently adjustable in height.

16. The blind of claim 14, further comprising a plurality of elongated members extending across the window and being connected to the side wall at multiple locations above the top edge and multiple locations below the bottom edge.

* * * * *